US006039623A

United States Patent [19]

Osuga et al.

[11] Patent Number: 6,039,623

[45] Date of Patent: Mar. 21, 2000

[54] DEFLECTING YOKE GRADIENT ADJUSTING APPARATUS

[75] Inventors: Satoshi Osuga; Yoshihiro Inamoto, both of Saitama, Japan

[73] Assignee: Sony Corporation, Tokyo, Japan

[21] Appl. No.: 08/661,403

[22] Filed: Jun. 7, 1996

[30] Foreign Application Priority Data

Jun. 14, 1995 [JP] Japan ..... 7-147250

[51] Int. Cl.[7] ..... H01J 9/00

[52] U.S. Cl. ..... 445/63; 445/DIG. 1

[58] Field of Search ..... 445/3 B, 63

[56] References Cited

U.S. PATENT DOCUMENTS

| | | | |
|---|---|---|---|
| 3,844,006 | 10/1974 | McGlashan | 445/3 B |
| 4,163,308 | 8/1979 | Tawa et al. | 445/3 B |
| 4,405,950 | 9/1983 | Wardell, Jr. | 445/63 |

FOREIGN PATENT DOCUMENTS

| | | | |
|---|---|---|---|
| 5-282998 | 10/1993 | Japan | 445/3 B |

*Primary Examiner*—Kenneth J. Ramsey
*Attorney, Agent, or Firm*—Jay H. Maioli

[57] ABSTRACT

A deflecting yoke gradient adjusting apparatus provided by the present invention comprises a base for mounting a CRT, positioning means for adjusting the position of the CRT mounted on the base, horizontal positioning means for positioning the deflecting yoke positioned within the horizontal positioning means which can move in a horizontal direction toward or away from the deflecting yoke tentatively mounted on the CRT and vertical positioning means for positioning the deflecting yoke in a direction perpendicular to the surface of the base. With the deflecting yoke gradient adjusting apparatus provided by the present invention, the efficiency of work to install a deflecting yoke in a cathode ray tube (CRT) employed in typically in a television, a projection type projector or a rear projection type projector and to adjust the position of the deflecting yoke can be enhanced.

3 Claims, 4 Drawing Sheets

DEFLECTING YOKE GRADIENT ADJUSTING APPARATUS

BACKGROUND OF THE INVENTION

1. Field of the Invention

The present invention relates to an installment/adjustment apparatus used for installing a deflecting yoke in a cathode ray tube (CRT) employed in typically in a television, a projection type projector or a rear projection type projector and adjusting the position of the deflecting yoke.

2. Description of Related Art

In a CRT, thermal electrons radiated from a thermal cathode are accelerated and converged to form an electron beam which is then deflected in the horizontal and vertical directions on the entire screen of the CRT by a magnetic field of a deflecting yoke. The electron beam is applied to a fluorescent surface through a shadow mask to be converted into light.

When the deflecting yoke is installed in a CRT, it is necessary to mount the deflecting yoke on the CRT and fix it thereon by using a means such as a screw tightener as well as to prevent color unevenness and to improve the color purity.

In order to mount the deflecting yoke on an assembly line and to adjust the gradient thereof, it is necessary to carry out rotation (tilt) adjustment of the deflecting yoke while watching the screen after the set has been assembled. It is feared that the manual adjustment done by the operator may produce variations in adjustment results. There is also a problem caused by danger of the operator touching a high-voltage terminal during the adjustment work which problem may result in an electric shock.

As is described above, the conventional adjustment method of a deflecting yoke is much dependent upon the skill of the operator and has a problem that the adjustment work is dangerous due to a fear of an electrical shock resulting from the adjustment which problem remains to be solved.

SUMMARY OF THE INVENTION

The deflecting yoke gradient adjusting apparatus provided by the present invention comprises a base for mounting a CRT, positioning means for adjusting the position of the CRT mounted on the base, horizontal positioning means for positioning the deflecting yoke located within the horizontal positioning means which can move in the horizontal direction toward or away from the deflecting yoke tentatively mounted on the CRT and vertical positioning means for positioning the deflecting yoke in a direction perpendicular to the surface of the base.

The positioning means can freely make a movement relative to the CRT mounted on the base. The end portions of the positioning means are formed by using a hard material made of compound resin.

By using the deflecting yoke gradient adjusting apparatus provided by the present invention, merely mounting the CRT on the base of the apparatus will keep the adjustment of the deflecting yoke in a uniform state without giving rise to variations in adjustment results. On the top of that, the fear of an electrical shock due to the touching of a high-voltage terminal by the operator or other causes does not exist any more, guaranteeing safety during the adjustment, work.

DESCRIPTION OF THE PREFERRED EMBODIMENTS

The present invention will become apparent from the following detailed description of preferred embodiments with reference to accompanying diagrams.

Figure 1:
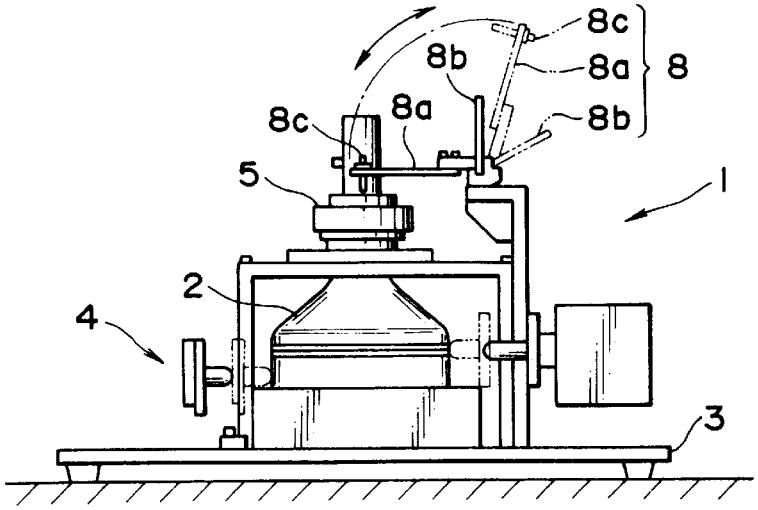
FIG. 1 is a diagram showing a front view of a deflecting yoke gradient adjusting apparatus provided by the present invention.

A first embodiment implementing a deflecting yoke gradient adjusting apparatus 1 in accordance with the present invention comprises a base 3 for mounting a CRT 2 and a CRT positioning apparatus 4 used as a positioning means for adjusting the position of the CRT 2 mounted on the base 3 as is shown in FIG. 1.

Figure 2:
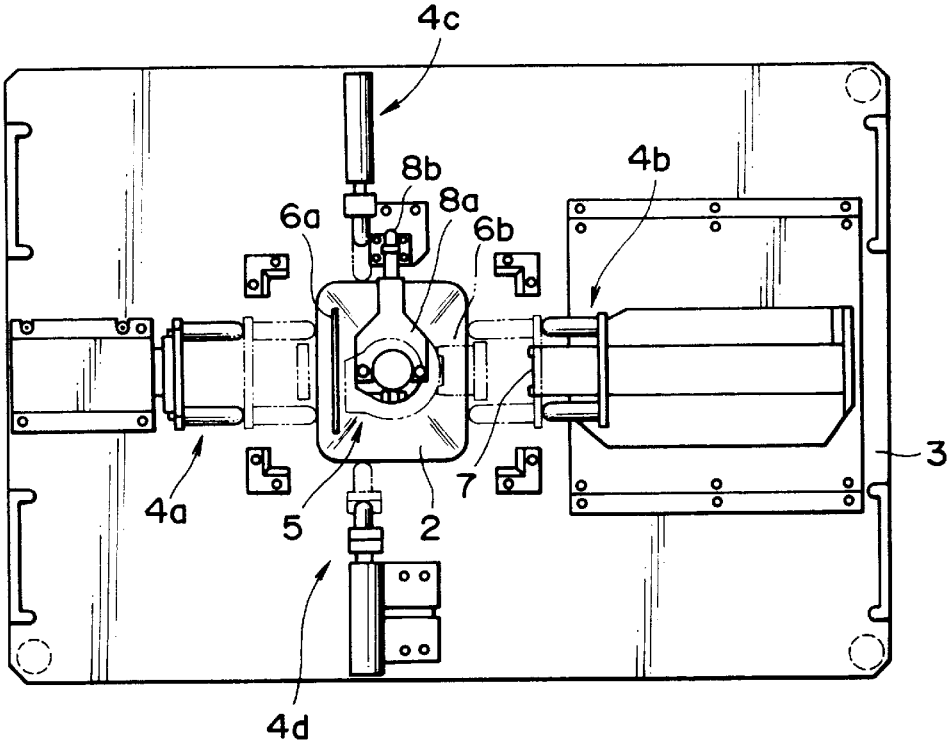
FIG. 2 is a diagram showing a plain view of the deflecting yoke gradient adjusting apparatus provided by the present invention.

The CRT positioning apparatus 4 is used for moving the CRT 2 mounted on the horizontal surface of the base 3 back and forth and to the right and left in the horizontal directions in order to set the CRT 2 at a predetermined location. As is shown in FIG. 2, the CRT positioning apparatus 4 has rods that are driven by an air cylinder to expand and contract. Adjustment units 4*a* and 4*b* in the right and left directions and adjustment units 4*c* and 4*d* in the forward and backward directions are each provided with one of the rods.

Figure 4A:
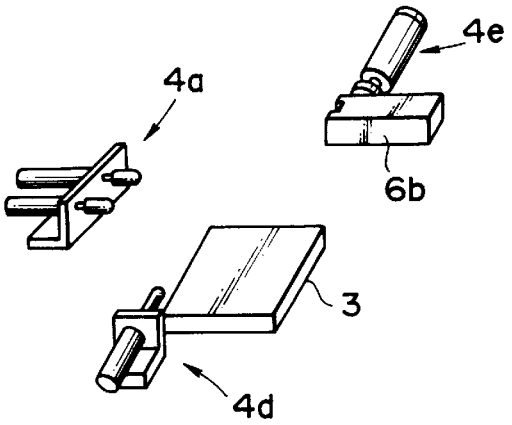
FIGS. 4A and 4B are explanatory diagrams showing states in which the deflecting yoke gradient adjusting apparatus provided by the present invention are being used.

It should be noted that, as another embodiment, the number of adjustment units is reduced for the sake of simplification and reduction of the manufacturing cost. For example, while the adjustment units 4*a* and 4*d* are retained, the functions of the adjustment units 4*b* and 4*c* are carried out by a single adjustment unit 4*e* in place of the adjustment units 4*b* and 4*c*. Refer to FIG. 4A. In this configuration, the positioning is done by pressing the corner of the CRT 2.

A pair of horizontal adjustment units 6*a* and 6*b* serving as horizontal positioning means for positioning the deflecting yoke 5 are provided on the base 3.

Figure 3:
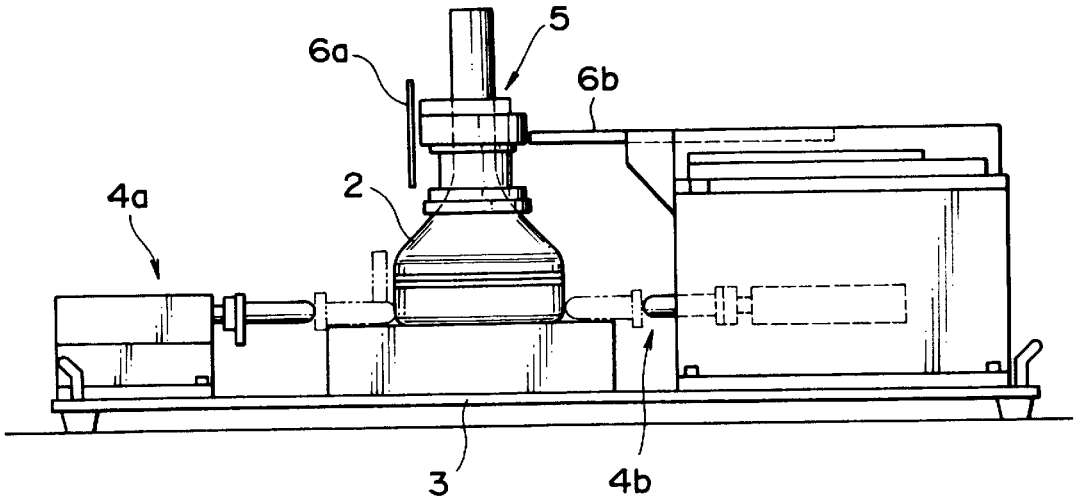
FIG. 3 is a diagram showing a side view of the deflecting yoke gradient adjusting apparatus provided by the present invention.

As is shown in FIGS. 2 and 3, the horizontal adjustment unit 6*a* is designed as a plane plate body having a vertical surface in such away that it can move freely in a horizontal direction. The other horizontal adjustment unit 6*b* is a horizontal plate body having a dent 7 at the end thereof that is in contact with the CRT 2. Likewise, the horizontal adjustment unit 6*b* is designed in such a way that it can move freely in a horizontal direction. In addition, some fine adjustment on the horizontal plane typically of the order of ±5 degrees can also be made as well.

Furthermore, a vertical adjustment unit 8 is provided to be used as a vertical positioning means for positioning the deflecting yoke 5 in a direction perpendicular to the base.

The vertical adjustment unit 8 positions the deflecting yoke 5 tentatively mounted on the CRT 2 by pushing it from the upper surface thereof toward the surface of the base. The vertical adjustment unit 8 has a plane plate body (or a clamp) 8*a* with its end thereof forms a two-long-point fork resembling the character U.

The plane plate body 8*a* is joined to a rotation lever 8*b* at the root main body of the vertical adjustment unit 8. The rotation lever 8*b* can be rotated manually. At the two-long-point portion of the plane plate body 8*a*, an adjustment screw 8*c* for position adjustment is provided.

The end portions of the horizontal and vertical adjustment units 6 and 8 which end portions are in contact with the CRT 2 or the deflecting yoke 5 are made of hard compound resin such as hard rubber or plastic.

The actual work to install a deflecting yoke 5 and adjust the position thereof by means of the deflecting yoke gradient adjusting apparatus 1 configured in accordance with the present invention as is described above is explained as follows.

Figure 4B:
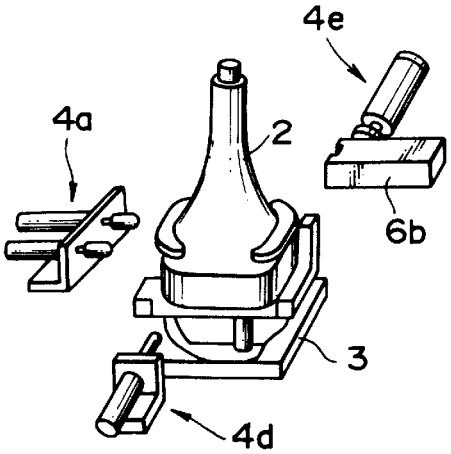

A state shown in FIG. 4A is an initial (start) state. As is shown in FIG. 4B, the CRT 2 to be adjusted is set on the base 3 with the bottom surface of the CRT 2 placed at a predetermined position on the base 3.

Figure 5A:
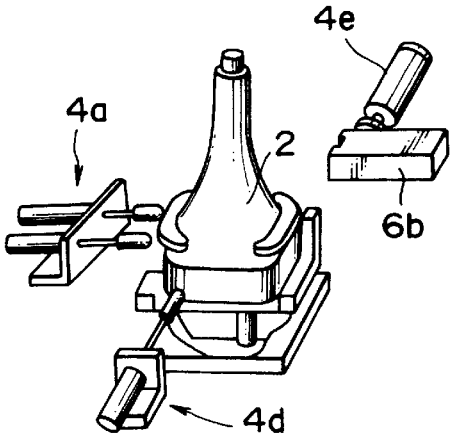
FIGS. 5A and 5B are explanatory diagrams showing states in which the deflecting yoke gradient adjusting apparatus provided by the present invention are being used.
Figure 5B:
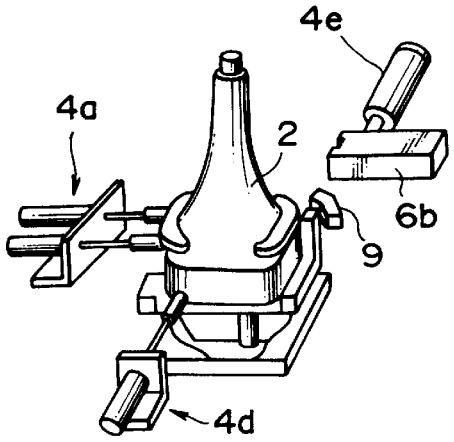

As shown in FIG. 5, the right/left direction adjustment unit 4*a* and the forward/backward direction adjustment unit 4*d* are actuated by expanding the rods thereof gradually step by step. At each step, the rods are expanded by a predetermined amount of expansion by supplying air.

Then, the rod of the forward/backward/right/left direction adjustment unit 4*e* is expanded. Since the end 9 of this rod is in contact with a corner of the CRT 2, the expansion of the rod moves the CRT 2, positioning it at a desired location.

Figure 6A:
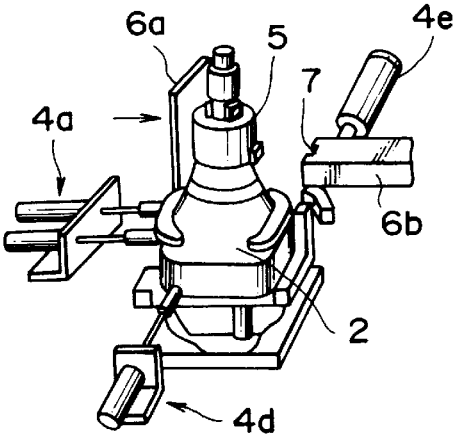
FIGS. 6A and 6B are explanatory diagrams showing states in which the deflecting yoke gradient adjusting apparatus provided by the present invention are being used.
Figure 6B:
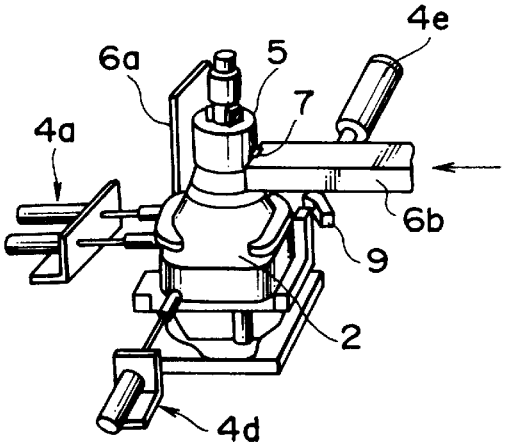

Then, the deflecting yoke 5 set tentatively on the CRT 2 is positioned by moving forward the horizontal adjustment unit 6*a* as is shown in FIG. 6. Subsequently, the deflecting yoke 5 is rotated by hand, adjusting the position of the deflecting yoke 5 to the dent 7 at the end of the horizontal adjustment unit 6*b*. The horizontal adjustment unit 6*b* is then moved forward so that the deflecting yoke 5 gets inserted into the dent 7. With the deflecting yoke 5 engaged with the dent 7, positioning work is carried out. It should be noted that since the horizontal adjustment unit 6*b* allows some fine adjustment on the horizontal plane typically of the order of ±5 degrees, adjustment can be made by rotating the deflecting yoke 5 if necessary.

Figure 7A:
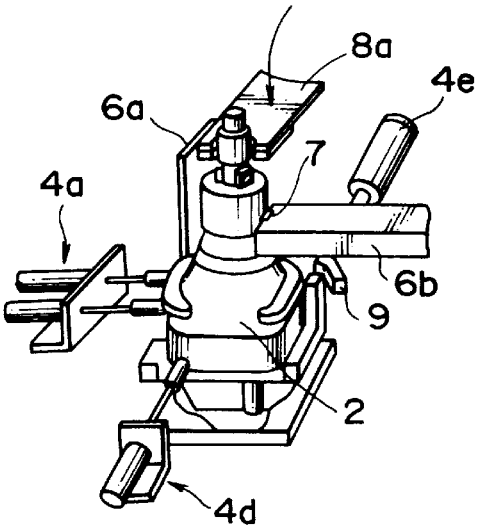
FIGS. 7A and 7B are explanatory diagrams showing states in which the deflecting yoke gradient adjusting apparatus provided by the present invention are being used.

Next, as is shown in FIG. 7A, the plane plate body (or clamp) 8*a* of the vertical adjustment unit 8 is rotated by manually rotating the rotation lever 8*b* joined to the plane plate body (or clamp) 8*a* till the end of the two-long-point portion thereof is brought in contact with the upper surface of the deflecting yoke 5. The rotation lever 8*b* is further rotated to position the deflecting yoke 5.

Figure 7B:
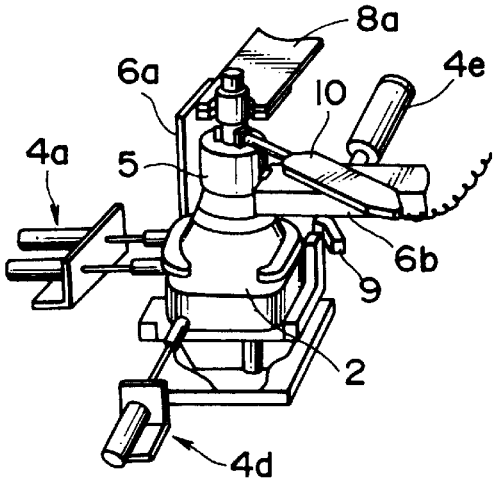

After the positioning of the deflecting yoke 5 on the CRT 2 described above has been completed, the screws are tightened by means of an air driver 10 in order to secure the position of the deflecting yoke 5 on the CRT 2 as shown in FIG. 7B.

Figure 8A:
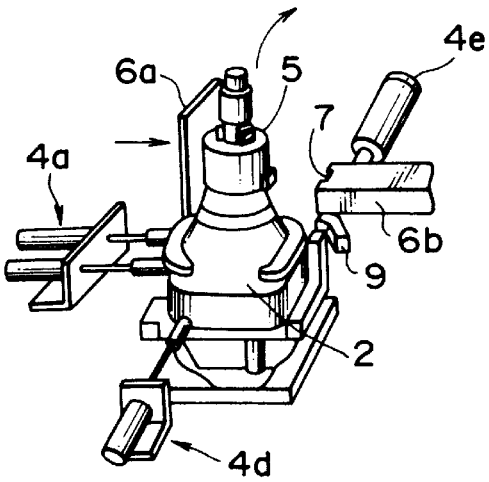
FIGS. 8A and 8B are explanatory diagrams showing states in which the deflecting yoke gradient adjusting apparatus provided by the present invention are being used.
Figure 8B:
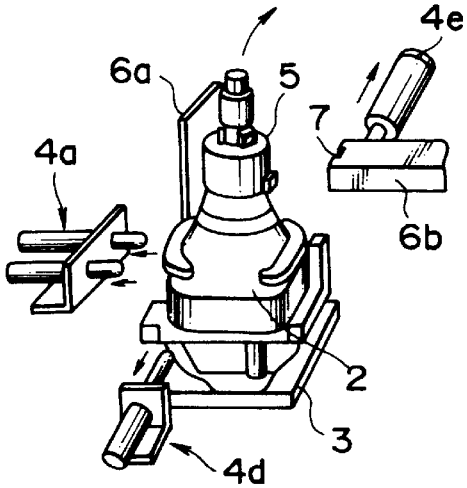

After the tightening of the deflecting yoke 5 has been completed, as is shown in FIG. 8, the plane plate body (or clamp) 8*a* of the vertical adjustment unit 8 is retreated and the horizontal adjustment unit 6*b* is pulled back. Then, the adjustment units 4*a*, 4*d* and 4*e* for positioning the CRT 2 are retreated before removing the CRT 2 from the base 3 to end the work to install the deflecting yoke 5 and adjust the position thereof.

In this way, the work to adjust a deflecting yoke can be carried out to give adjustment results having certain uniformity in a short period of time by means of the deflecting yoke gradient adjusting apparatus 1 provided by the present invention independently of the skill and experience of the operator.

It should be noted that the method of driving the adjustment units is not limited particularly to the technique using the air cylinder. Other methods such as the oil-pressure driving technique or the control motor driving technique can also be adopted as well.

As is described above, the present invention provides a deflecting yoke gradient adjusting apparatus comprising a base for mounting a CRT, positioning means for adjusting the position of the CRT mounted on the base, horizontal positioning means for positioning the deflecting yoke positioned within the horizontal positioning means which can move in a horizontal direction toward or away from the deflecting yoke tentatively mounted on the CRT and vertical positioning means for positioning the deflecting yoke in a direction perpendicular to the surface of the base, whereby the efficiency of the work to install a deflecting yoke on the CRT and adjust the position thereof can be increased and the number of operations can be reduced. On the top of that, the deflecting yoke gradient adjusting apparatus has an excellent effect on the enhancement of the work safety by elimination of the risk of the operator incurring an electrical shock.

What is claimed is:

1. A deflecting yoke gradient adjusting apparatus comprising a base for mounting a CRT, positioning means for adjusting the position of said CRT mounted on said base, horizontal positioning means for positioning said deflecting yoke positioned within said horizontal positioning means which can move in a horizontal direction toward or away from said deflecting yoke tentatively mounted on said CRT and vertical positioning means for positioning said deflecting yoke in a direction perpendicular to the surface of said base.

2. A deflecting yoke gradient adjusting apparatus according to claim 1 wherein all said positioning means can be driven freely into movements relative to said CRT.

3. A deflecting yoke gradient adjusting apparatus according to claim 1 wherein end portions of all said positioning means are created from a hard material made of compound resin.

* * * * *